US007923709B1

(12) United States Patent
Chen et al.

(10) Patent No.: US 7,923,709 B1
(45) Date of Patent: Apr. 12, 2011

(54) RADIATION SHIELDING SYSTEMS USING NANOTECHNOLOGY

(75) Inventors: Bin Chen, Palo Alto, CA (US); Christoper P. McKay, Sunnyvale, CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 300 days.

(21) Appl. No.: 12/273,502

(22) Filed: Nov. 18, 2008

(51) Int. Cl.
*G21F 3/00* (2006.01)
*H05M 4/02* (2006.01)
*H05M 4/96* (2006.01)

(52) U.S. Cl. ..... 250/515.1; 250/505.1; 438/58; 438/474; 438/798; 429/532; 429/231.8; 516/32

(58) Field of Classification Search ..... 250/515.1, 250/505.1; 438/58, 474, 798; 429/532, 231.8; 516/32
See application file for complete search history.

(56) References Cited

U.S. PATENT DOCUMENTS

| | | | | |
|---|---|---|---|---|
| 7,365,100 | B2 * | 4/2008 | Kuper et al. | 516/32 |
| 2002/0035170 | A1 | 3/2002 | Glatkowski et al. | |
| 2010/0159366 | A1 * | 6/2010 | Shao-Horn et al. | 429/532 |
| 2010/0284086 | A1 * | 11/2010 | Novack et al. | 359/580 |

* cited by examiner

*Primary Examiner* — Nikita Wells
(74) *Attorney, Agent, or Firm* — John F. Schipper; Robert M. Padilla

(57) ABSTRACT

A system for shielding personnel and/or equipment from radiation particles. In one embodiment, a first substrate is connected to a first array or perpendicularly oriented metal-like fingers, and a second, electrically conducting substrate has an array of carbon nanostructure (CNS) fingers, coated with an electro-active polymer extending toward, but spaced apart from, the first substrate fingers. An electric current and electric charge discharge and dissipation system, connected to the second substrate, receives a current and/or voltage pulse initially generated when the first substrate receives incident radiation. In another embodiment, an array of CNSs is immersed in a first layer of hydrogen-rich polymers and in a second layer of metal-like material. In another embodiment, a one- or two-dimensional assembly of fibers containing CNSs embedded in a metal-like matrix serves as a radiation-protective fabric or body covering.

17 Claims, 2 Drawing Sheets

RADIATION SHIELDING SYSTEMS USING NANOTECHNOLOGY

ORIGIN OF THE INVENTION

The invention described herein was made in the performance of work under a NASA contract and by an employee of the United States Government and is subject to the provisions of Public Law 96-517 (35 U.S.C. §202) and may be manufactured and used by or for the Government for governmental purposes without the payment of any royalties thereon or therefore.

FIELD OF THE INVENTION

This invention relates to use of a composite materials system, including carbon nano structures for shielding of radiation.

BACKGROUND OF THE INVENTION

Shielding of personnel and sensitive electronic equipment on a space vehicle from radiation damage becomes more important when the space vehicle moves beyond the Earth's atmosphere for an extended time interval. Extant radiation can include gamma rays, X-rays, ultraviolet rays, neutrons, protons, pi mesons, energetic ions and electrons, among others, and several types of these radiation particles can be received simultaneously. Each type of particle has its own energy transfer characteristics and requires particular materials and apparatus for radiation protection. Simultaneous receipt of several types of such radiation makes it difficult to protect the personnel and equipment without increasing the mass of the protective apparatus beyond reasonable bounds. Further, the dominant radiation types can change as the vehicle changes its location or orientation so that prompt changes in types of protection may also be necessary.

What is needed is a system that receives two or more types of radiation (e.g., gamma rays, X-rays, ultraviolet rays, neutrons, protons, pi mesons, energetic ions and/or electrons) and converts and dissipates a substantial portion of the radiation energy. Preferably, the system should be flexible so that, when different radiation particles A and B, having numerical fractions $f_A$ and $f_B$ ($0<f_A+f_B\leqq 1$), are known to be present in the radiation, the material composition can be modified to approximately optimize a metric representing total energy or total fluence dissipated.

SUMMARY OF THE INVENTION

These needs are met by the invention, which provides, in one embodiment, a first array of metal-line fingers, having average height h1, average diameter d1 and average areal density ρ1, extending substantially perpendicular to and connected to a first substrate. The first array faces a second array of carbon nanostructures (CNSs), having an average height h2, and average diameter d2 and an average areal density ρ2, oriented substantially parallel to the first array and spaced apart from the exposed ends of the metal-like fingers of the first array by an average distance d3. The CNSs in the second array are coated with a selected electro-polymer, such as polyethylene (PE) or poly-pyrrole (PPy), and are electrically connected to an electrically conducting channel in a second substrate that is in turn connected to an electrical current and voltage pulse dissipation mechanism. Optionally, the first substrate and the channel are connected through a battery or voltage producing mechanism. A carbon nanostructure may be a collection of nanotubes (single wall or multi-wall), fibers, belts or similar structures containing primarily carbon arranged in an appropriate configuration.

In a second embodiment, an array of CNSs, having a selected average height and a selected areal density, is connected to an electrically conducting substrate and is immersed in a first layer of hydrogen-rich polymers and in a second metal-like layer. The substrate is connected to an electrical current and voltage pulse dissipation mechanism.

In a third embodiment, a first array of parallel threads, each including a plurality of CNSs immersed in a metal-like compound, is attached to a substrate that is in turn connected to an electrical current and voltage pulse dissipation mechanism.

DESCRIPTION OF BEST MODE OF THE INVENTION

Figure 1:
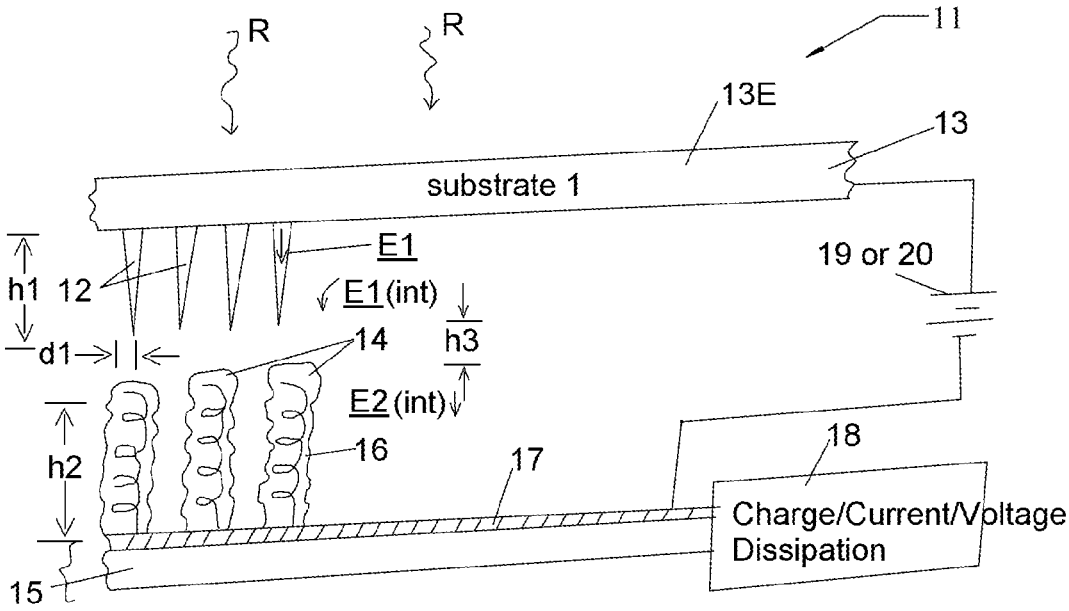
FIGS. 1, 2, 3A and 3B schematically illustrate systems for shielding radiation and dissipating most or all of the associated electrical charge or current or voltage pulse(s) associated with receipt of a radiation pulse.

FIG. 1 illustrates a first embodiment of a system 11 for radiation shielding according to the invention. A first array of metal-like fingers 12 is connected to, and extends substantially perpendicular from, a first substrate 13. The fingers 12 in the first array have average lengths h1, average diameters d1, and an average areal density of ρ1, with an associated average linear density proportional to $\sqrt{\rho 1}$. A second array of carbon nanostructures (CNSs) 14 extends from a second substrate 15 toward the first substrate 13 in a direction substantially parallel to the direction of extension of the fingers 12. The CNSs are coated with an electro-active polymer 16, such as polyethylene (PE) or poly-pyrrole (PPy) and are connected to an electrically conducting transport component 17 of the second substrate 15, which is connected at one or more locations to an electrical current pulse/voltage pulse dissipation mechanism 18. The CNSs 14 in the second array have average length h2, average diameter d2 and average areal density ρ2, with an associated average linear density proportional to $\sqrt{\rho 2}$. The exposed ends of the fingers 12 are spaced apart from the exposed ends of the CNSs, with a finger-CNS nearest-neighbor tip distance in a range h3=0.1-5 μm. A metal-like finger 12 may contain one or more of the elements Ti, Mo, W, Os, Co, Rh, Ir, Ni, Cu, Ag, Au, Zn and Cd, most of which have an electrical conductivity parameter in a range from 0.11-0.61 $(\text{micro-Ohms})^{-1}$.

A radiation field R arrives first at an exposed surface 13E of the first substrate 13 and produces an associated first electrical field E1 within the metal-like fingers 12. This field E1 is intensified near the exposed tips of the fingers 12, and this intensified field E1(int) generates an intensified second electrical field E2(int) near the adjacent exposed tips of the coated CNSs 14, which generates an associated electrical current J2 in the CNSs 14 and the associated electro-polymer coating 16. The current J2 is received by the second substrate transport component 17 and transported to the dissipation mechanism 18 located contiguous to the second substrate.

Optionally, the CNSs 14 and/or electro-polymer coating 16 can be maintained at a voltage and polarity, relative to a voltage in the metal-like fingers 12, to enhance or encourage flow of electrically charged particles, generated within the fingers, toward the CNSs and/or electro-polymer coating, by imposing a voltage bias (e.g., 5-500 V) through a voltage bias source 19 connected to the first substrate 13 and the second substrate transport component 17. For example, receipt of an energetic proton beam by middle or heavy weight atoms in the first substrate will more likely produce energetic free electrons in or adjacent to the metal fingers 12, and providing a positive voltage bias at or adjacent to the CNSs and/or at the electro-polymer material in the second array will more likely encourage the free electrons to move toward, and to deposit part or all of their energy at, the second array, where this energy can be dissipated. The voltage bias source 19 may be replaced by a voltage difference module 20 that utilizes a resulting voltage difference between the first substrate 13 and the second substrate transport component 17 to perform useful work, for example, a meter or other instrument to estimate a current or voltage peak associated with arrival of the radiation R.

Figure 2:
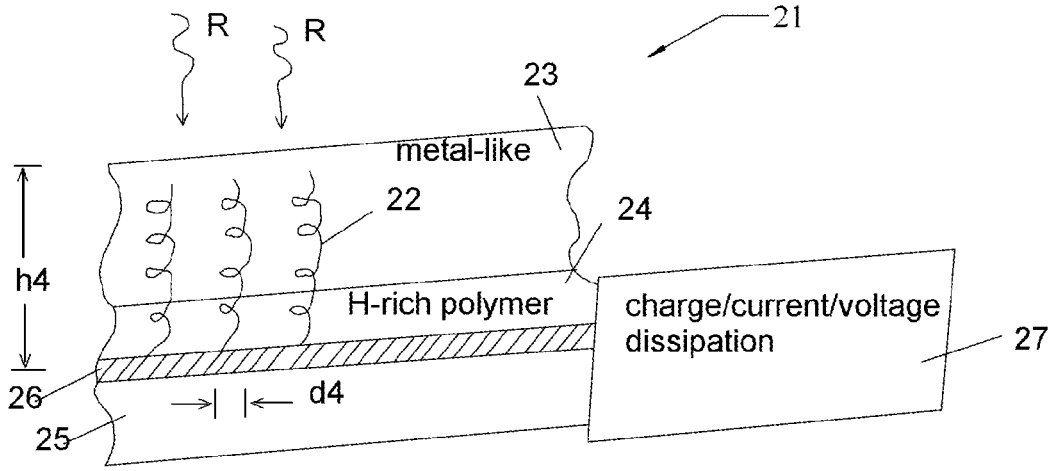

FIG. 2 illustrates a second embodiment of a system 21 for radiation shielding according to the invention. An upper portion of each of an array of CNSs 22 is immersed in a high Z metal or metal-like layer 23, such as W or Pb or Ti, and a lower portion of each of the CNSs is immersed in a hydrogen-rich, monomer or polymer (HRP), such as polyimide (R(CO)NR'(CO)R"), methylene, ethylene, poly-methylmethacrylate (PMMA) or a similar carbon-based compound. Preferably, the CNSs 22 have lengths h4≈200-800 nm and diameters d4≈10-20 nm; the HRP layer 24 has a thickness h6≈1-30 μm, and the metal-like layer 23 has a thickness in a range of 1-30 μm; and the longitudinal axes of the CNSs 22 are substantially parallel. The CNSs 22, are attached to a substrate 25, having an electrically conducting transport channel 26 that is connected to a charge/current/voltage pulse dissipation mechanism 27. The system 21 includes a plurality of the triple of structures, 22, 23 and 24, and the substrate components, 25 and 26.

Depending upon the anticipated signum of the net electric charges on particles that are part of an incident radiation field R, the dissipation mechanism 18 or 27 in FIG. 1 or FIG. 2, can be maintained at a positive voltage or at a negative voltage relative to the quiescent voltage(s) of the CNSs and metal-like structures 22 and 23, in order to promote capture of these electrically charged particles at the dissipation mechanism, 18 or 27.

A radiation field R, moving toward the system, 11 or 21, may include charged particles and ions, high energy electromagnetic rays and/or high energy neutrons. Part or all of the particle energy is converted to electric current pulses and/or voltage pulses by one or more of these structures, and this converted energy is dissipated by the dissipation mechanism, 18 or 27.

A CNS, such as a carbon nanotube (CNT) has an associated thermal conductivity as high as 3000 Watts/cm$^2$, which compares favorably with the maximum thermal conductivity for diamond (about 3400 Watts/cm$^2$, in a transverse direction), with correspondingly high values for electrical conductivity. A limiting factor for dissipation of electrical charge, electrical current pulses and/or voltage pulses is likely to be the product of electrical conductivity and cross sectional area for the transport channel and/or the maximum dissipation rate for the dissipation mechanism, 18 or 27 in FIG. 1 or 2.

Figure 3A:
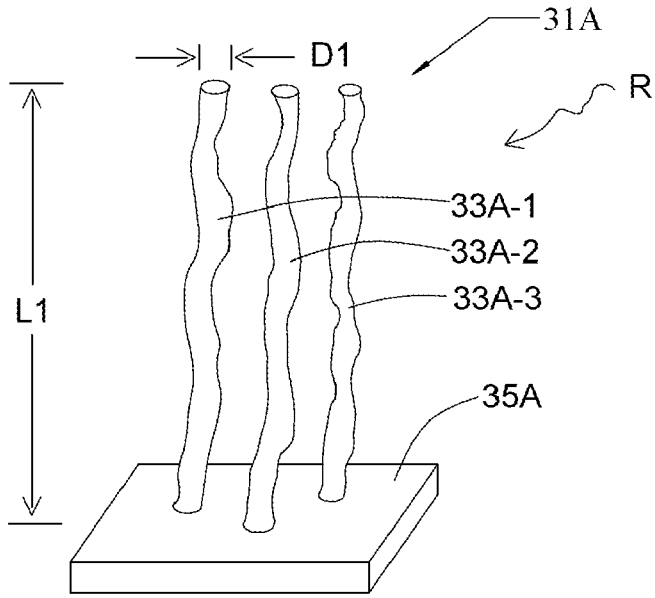

FIG. 3A illustrates a fabric, body covering or other layered or laminated body protection system that can be used to greatly reduce the effects of radiation incident on a person. An assembly 31A of extruded fibers 33A-n1 (n1=1, . . . , N1; N1≧3) is provided, extending primarily in one direction and containing (1) CNSs of length 200-1000 nm or longer and (2) metal filler material surrounding the CNSs. The extruded fibers are arranged in a sheet-like structure and are closely spaced, having diameters of D1≈100-500 nm, and having lengths L1≈10-100 cm, or higher if desired. One end (or both ends) of each of the fibers 33A-n1 is connected to an electrical current/voltage pulse dissipation mechanism 35A. When radiation R is incident upon, and is received by, the assembly 31A, an electrical current pulse and/or voltage pulse is generated in the fibers 33-n1 and is received and dissipated by the dissipation mechanism 35A. Preferably, the fibers 33A-n1 are contiguous, or nearly contiguous, so that little or no incident radiation "leaks through" between adjacent fibers, and most of the incident radiation pulse is received and dissipated by the assembly 31A.

Figure 3B:
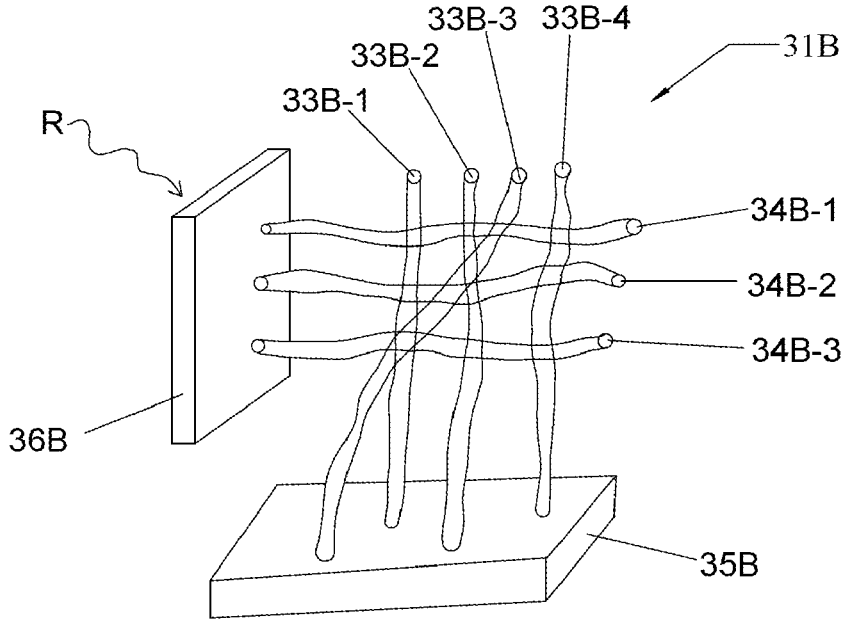

FIG. 3B illustrates a two dimensional fabric, body covering or other layered or laminated body protection system that can be used to greatly reduce the effects of radiation incident on a person. An assembly 31B of a first set of extruded fibers 33B-n2 (n2=1, . . . , N2; N2≧3) in a first direction is interwoven with a second set of extruded fibers 33B-n3 (n3=1, . . . , N3; N3≧3), extending primarily in a second direction that is transverse to the first direction, to form a sheet-like structure. Each of the first and second sets of fibers contains (1) CNSs of length 200-1000 nm or longer and (2) metal filler material, the extruded fibers being closely spaced, having diameters of D2≈100-500 nm, and having lengths L2≈10-100 cm, or higher if desired. One end (or both ends) of each of the fibers 33B-n2 is connected to a first electrical current/voltage pulse dissipation mechanism 35B. One end (or both ends) of each of the fibers 34B-n3 is connected to a second electrical current/voltage pulse dissipation mechanism 36B, which may be coincident with or separate from the first dissipation mechanism 35B. In either of the configurations shown in FIGS. 3A and 3B, one or more of the sets of fibers, 33A-n1 or 33B-n2 or 33B-n3, may cross another fiber in the same set, as illustrated in FIG. 3B. When radiation R is incident upon, and is received by, the assembly 31B, an electrical current pulse and/or voltage pulse is generated in the fibers 33B-n2 and/or in the fibers 33B-n3 and is received and dissipated by the first dissipation mechanism 35B and/or by the second dissipation mechanism 36B. Preferably, the fibers 33B-n2 are contiguous, or nearly contiguous, and the fibers 33B-n3 are contiguous, or nearly contiguous. Preferably, at least one fiber 33B-n2 in the first set is connected to at least one fiber 34B-n3 in the second set, in order to equalize an electrical load generated when one or the other of these fibers receives an incident radiation pulse.

The invention can be used in space operations to shield instruments and components that are especially sensitive to gamma rays, X-rays, ultraviolet rays, neutrons, protons, pi mesons, and high energy ions and electrons, that a space vehicle may encounter, where most of the energy and particle flux is attenuated by passage of these particles through the atmosphere to reach the Earth's surface. Two or more layers of the invention may be used to provide multi-layer protection against very high energy particles, such as cosmic rays in space.

What is claimed is:

1. A system for shielding from radiation particles, the system comprising:

a first substrate, having an array of metal-like fingers connected to a first substrate first surface at a first end of each finger, with each finger being oriented substantially perpendicular to the first surface of the first substrate, where the fingers have an average length h1 in a range of 100-1000 nm, an average diameter d1 in a range of 10-50 nm and an average areal density ρ1 in a range of 0.05-0.5 gm/cm$^2$;

a second electrically conducting substrate, spaced apart from the first substrate and having an array of carbon nanostructures ("CNSs") connected to a first surface of the second substrate, with each CNS being oriented substantially perpendicular to the first surface of the second substrate and extending toward the array of metal-like fingers, where the CNSs have an average length h2 in a range of 50-100 nm, an average diameter d2 in a range of 10-50 nm and an average areal density ρ2 in a range of 0.05-0.5 gm/cm$^2$, where at least one CNS is coated with a selected electro-polymer having an average coating thickness th1 in a range of 100-1000 nm, where an exposed end of a selected CNS and an exposed end of a finger that is a nearest neighbor to the selected CNS have an average spacing of h3 in a range of 50-1000 nm; and an electric current/voltage pulse discharge and dissipation system, connected to the second substrate at one or more second substrate locations, to receive and dissipate at least one of an electric current or voltage pulse received from the second substrate, whereby at least one radiation particle, received at the first substrate, generates at least one of an electric current pulse and a voltage pulse that is received by the fingers, received by the CNS and electro-polymer coating, received by the second substrate, and dissipated by the discharge and dissipation system.

2. The system of claim 1, wherein a first portion of said second substrate comprises an electrical signal transport channel, having an electrical conductivity at least twice as large as electrical conductivity of a second portion of said second substrate, wherein the charge transport channel is connected to said discharge and dissipation mechanism.

3. The system of claim 2, further comprising a voltage bias source, connected between said first and second substrates, to impress a selected voltage difference between said electrical signal transport channel and said first substrate.

4. The system of claim 1, further comprising a voltage utilization mechanism, connected between said first and second substrates, that performs useful work when a magnitude of voltage difference between said second substrate and said first substrate is at least equal to a threshold value.

5. The system of claim 1, wherein at least one of said metal-like fingers contains at least one metal drawn from a group of metals consisting of Ti, Mo, W, Os, Co, Rh, Ir, Ni, Cu, Ag, Au, Zn and Cd.

6. The system of claim 1, wherein said electro-active polymer coating includes at least one of polyethylene and polypyrrole.

7. The system of claim 1, applied to shield at least one instrument or component in a space vehicle that is exposed to at least one incident particle, drawn from a collection of particles consisting of gamma rays, X-rays, ultraviolet rays, neutrons, protons, pi mesons, and high energy ions and electrons, before the incident particle has passed through at least a portion of the Earth's atmosphere.

8. A system for shielding from radiation particles, the system comprising:

a substrate, having an array of carbon nanostructures ("CNSs") connected to a first surface of the substrate, with each CNS being oriented substantially perpendicular to the first surface of the substrate, where the CNSs have an average length h1 in a range of 100-1000 nm, an average diameter d1 in a range of 10-50 nm and an average areal density ρ1 in a range of 0.05-0.5 gm/cm$^2$, the substrate having a charge transport channel, having an electrical conductivity at least twice as large as electrical conductivity of a second portion of said substrate, configured to transport one or more pulses of electrical current or voltage from the substrate to a region adjacent to the substrate;

a first layer, covering the first surface of the substrate and enclosing a lower portion of the CNSs, comprising a hydrogen-rich, electro-active monomer or polymer and having a thickness th1 in a range 1-30 μm;

a second layer, covering an exposed surface of the first layer and a remaining portion of the CNSs so that the first layer lies between and is contiguous to the substrate and the second layer, the second layer comprising a metal-like compound and having a thickness th2 in a range 1-30 μm;

an electric current/voltage pulse discharge and dissipation system, connected to the charge transport channel, to receive and dissipate at least one of an electric current pulse or a voltage pulse received from the transport channel, whereby at least one radiation particle, incident on the substrate, generates at least one of an electric current pulse and a voltage pulse that is received by the metal-like layer, is received by the hydrogen-rich layer, is received by the CNS and received by the substrate, and is dissipated by the discharge and dissipation system.

9. The system of claim 8, wherein at least one of said metal-like fingers contains at least one metal drawn from a group of metals consisting of Ti, Mo, W, Os, Co, Rh, Ir, Ni, Cu, Ag, Au, Zn and Cd.

10. The system of claim 8, wherein said hydrogen-rich monomer or polymer compound includes at least one of polyimide (R(CO)NR'(CO)R"), methylene, ethylene, poly-methylmethacrylate (PMMA).

11. The system of claim 8, applied to shield at least one instrument or component in a space vehicle that is exposed to at least one incident particle, drawn from a collection of particles consisting of gamma rays, X-rays, ultraviolet rays, neutrons, protons, pi mesons, and high energy ions and electrons, before the incident particle has passed through at least a portion of the Earth's atmosphere.

12. A system for shielding from radiation particles, the system comprising:

a plurality of electrically conducting fibers oriented substantially in a first direction, each fiber comprising at least first and second carbon nanostructures ("CNSs"), oriented generally in the first direction and being enveloped in a matrix of metal-like material, each fiber being substantially contiguous to at least one other fiber in the plurality; and an electric current/voltage pulse discharge and dissipation system, connected to at least one end of each of the fibers, to receive and dissipate at least one of an electric current pulse and a voltage pulse received from the fiber.

13. The system of claim 12, wherein said metal-like matrix material contains at least one metal drawn from a group of metals consisting of Ti, Mo, W, Os, Co, Rh, Ir, Ni, Cu, Ag, Au, Zn and Cd.

14. The system of claim 12, further comprising:

a second plurality of electrically conducting fibers oriented substantially in a second direction that is transverse to said first direction, each fiber in the second plurality comprising at least third and fourth carbon nanostructures ("CNSs"), oriented generally in the second direction and being enveloped in a second matrix of metal-like material, each fiber in the second plurality being substantially contiguous to at least one other fiber in the second plurality; and a second electric current/voltage pulse discharge and dissipation system, connected to at least one end of each of the fibers in the second plurality, to receive and dissipate at least one of an electric current pulse and a voltage pulse received from the fiber in the second plurality.

15. The system of claim 14, wherein said second metal-like matrix material contains at least one metal drawn from a group of metals consisting of Ti, Mo, W, Os, Co, Rh, Ir, Ni, Cu, Ag, Au, Zn and Cd.

16. The system of claim 12, wherein at least one of said at least first and second fibers in said first plurality is electrically connected to at least one of said at least third and fourth fibers in said second plurality.

17. The system of claim 12, applied to shield at least one instrument or component in a space vehicle that is exposed to at least one incident particle, drawn from a collection of particles consisting of gamma rays, X-rays, ultraviolet rays, neutrons, protons, pi mesons, and high energy ions and electrons, before the incident particle has passed through at least a portion of the Earth's atmosphere.

* * * * *